US006896402B2

(12) United States Patent
Desinano

(10) Patent No.: US 6,896,402 B2
(45) Date of Patent: May 24, 2005

(54) SAFETY DEVICE FOR STIRRING ASSEMBLIES FOR APPLICATION TO SHELF PAINT VESSELS

(76) Inventor: Carlo Desinano, Localita Faustina, 63, 20080 Albairate (Milan) (IT)

( * ) Notice: Subject to any disclaimer, the term of this patent is extended or adjusted under 35 U.S.C. 154(b) by 456 days.

(21) Appl. No.: 10/075,858

(22) Filed: Feb. 13, 2002

(65) Prior Publication Data

US 2003/0086334 A1 May 8, 2003

(30) Foreign Application Priority Data

Nov. 7, 2001 (IT) ..... MI2001A2341

(51) Int. Cl.[7] ..... B01F 15/00
(52) U.S. Cl. ..... 366/197; 366/247; 366/605
(58) Field of Search ..... 366/197, 198, 366/242–251, 347, 605

(56) References Cited

U.S. PATENT DOCUMENTS 5,096,071 A * 3/1992 Neri ..... 366/605
5,368,389 A * 11/1994 Dedoes ..... 366/247
5,498,077 A * 3/1996 Krzywdzjak et al. ..... 366/247
5,800,057 A * 9/1998 Lesimple ..... 366/198
5,988,868 A * 11/1999 Dedoes ..... 366/198

FOREIGN PATENT DOCUMENTS

EP 630764 A1 * 12/1994
EP 633055 A1 * 1/1995

* cited by examiner

*Primary Examiner*—Charles E. Cooley
(74) *Attorney, Agent, or Firm*—Hedman & Costigan, P.C.

(57) ABSTRACT

A safety device for stirring assemblies to be applied to shelf paint vessels and the like, which includes a top portion including a coupling tooth for coupling to a top portion of the shelf, a driving screw mechanism, guide elements for arranging and centering a stirring cover, and a further coupling tooth for coupling to a bottom portion which is provided for covering an element for supporting a stirring assembly and all the driven elements of the device.

10 Claims, 3 Drawing Sheets

SAFETY DEVICE FOR STIRRING ASSEMBLIES FOR APPLICATION TO SHELF PAINT VESSELS

BACKGROUND OF THE INVENTION

The present invention relates to a safety device for stirring assemblies, to be applied to shelf paint vessels and the like.

As is known, the shelf paint vessel stirrers are devices designed for stirring the paint held in a vessel, and, to that end, use a driving assembly which transmit the required drive by engaging in a horn fitting, provided on the top portion of the stirring vessel cover.

Prior stirring devices which, during the stirring operation, are operatively driven, do not include protective means and, accordingly, are very dangerous for the operators.

SUMMARY OF THE INVENTION

Accordingly, the aim of the present invention is to provide a safety device which can be used with a lot of different stirring assemblies, to be applied to shelf paint vessels and the like.

Within the scope of the above mentioned aim, a main object of the present invention is to provide such a safety device, which is adapted to protect all the driven elements of the stirring assembly and, accordingly, all the potentially dangerous elements.

Another object of the present invention is to provide such a safety device which can be perfectly integrated in the stirring assembly, and which is adapted to improve the operation of said stirring assembly.

Yet another object of the present invention is to provide such a safety device which is very advantageous from a mere economic standpoint and which, accordingly, can be broadly used, while providing very satisfactory safety advantages. According to one aspect of the present invention, the above mentioned aim and objects, as well as yet other objects, which will become more apparent hereinafter, are achieved by a safety device for stirring assemblies, to be applied to shelf paint vessels, characterized in that said safety device comprises a top portion having coupling means for coupling to a top part of a shelf, comprising driving means, means for locating and centering the stirring cover, and further coupling means for coupling to a bottom portion, provided for covering a supporting element for supporting stirring means and all the provided driven elements.

BRIEF DESCRIPTION OF THE DRAWINGS

Further characteristics and advantages of the present invention will become more apparent hereinafter from the following detailed disclosure of a preferred, though not exclusive, embodiment thereof, which is illustrated, by way of an indicative, but not limitative, example, in the accompanying drawings, where.

DESCRIPTION OF THE PREFERRED EMBODIMENT

Figure 1:
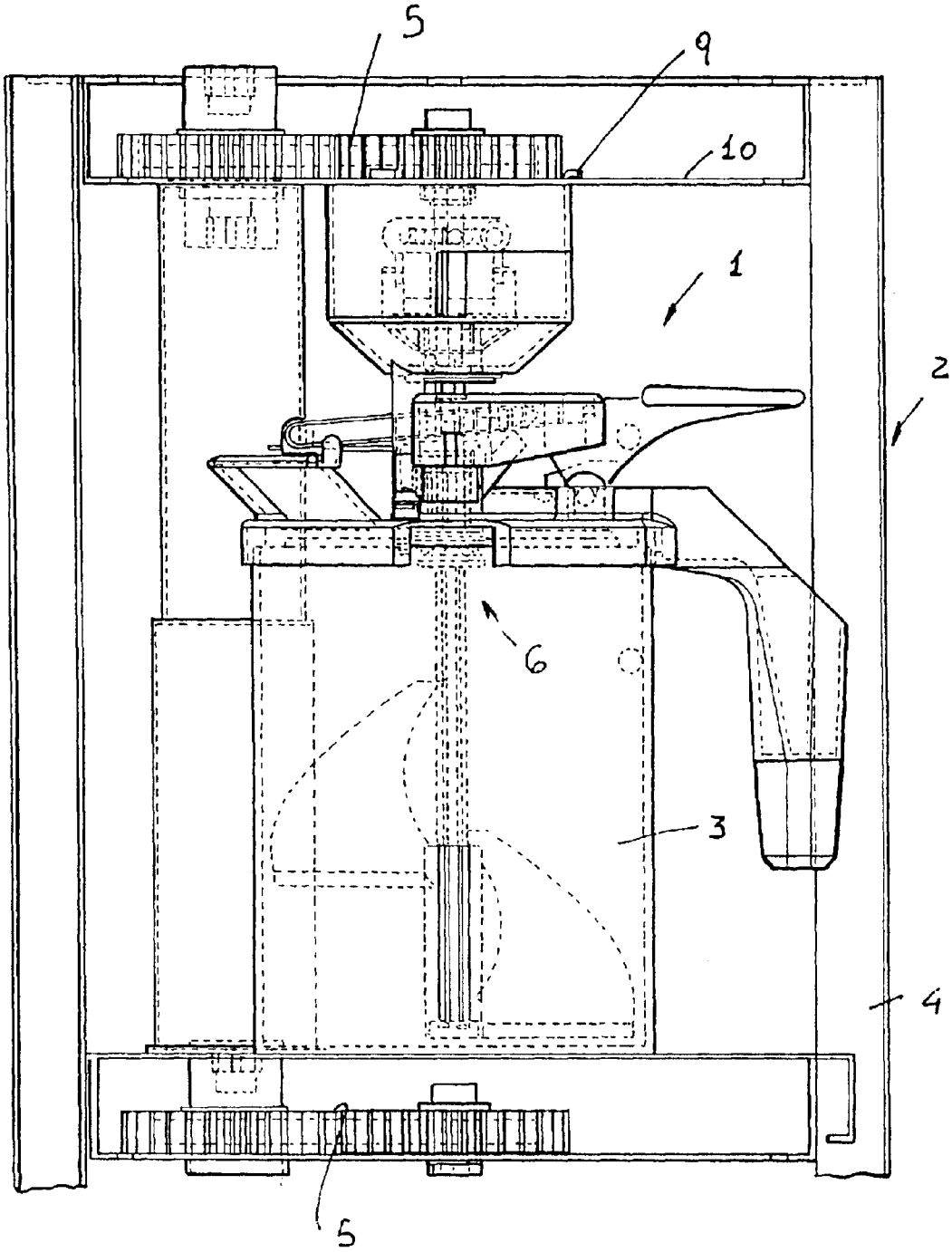
FIG. 1 is an elevation cross-sectioned view of a stirring apparatus including the safety device according to the present invention.
Figure 2:
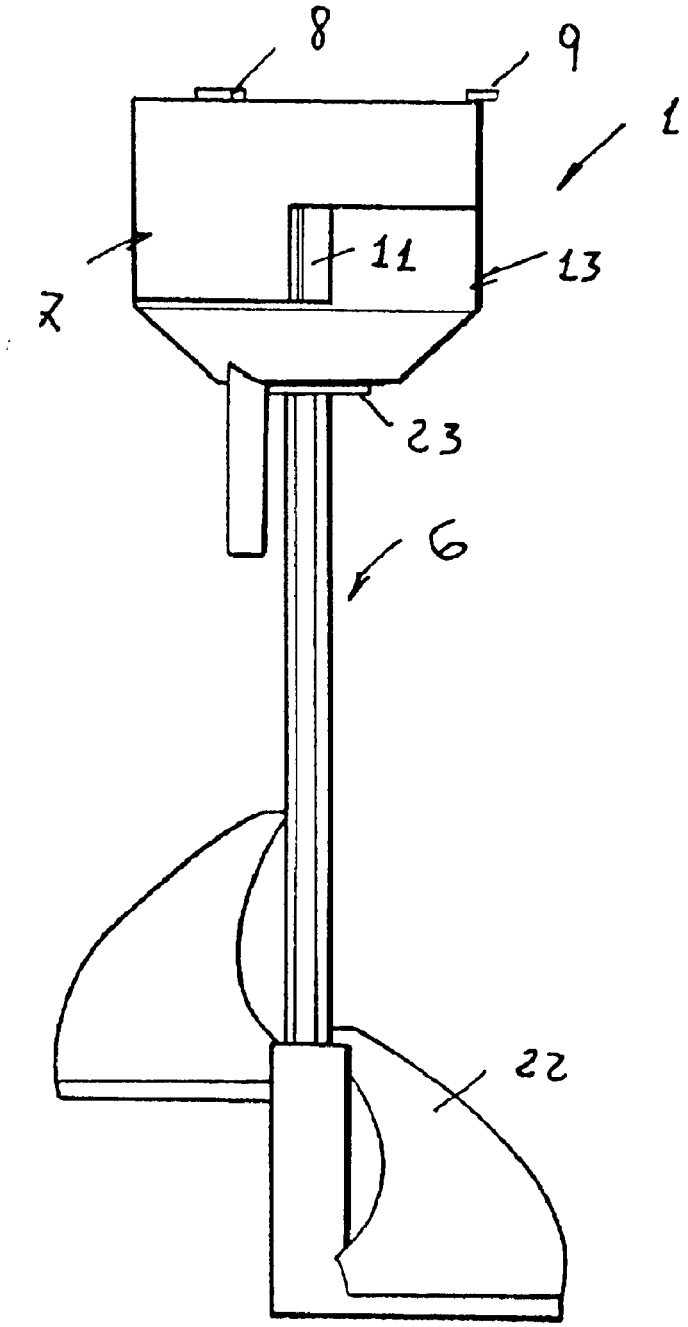
FIG. 2 is a further elevation view of the safety device according to the invention and the stirring assembly associated therewith.
Figure 3:
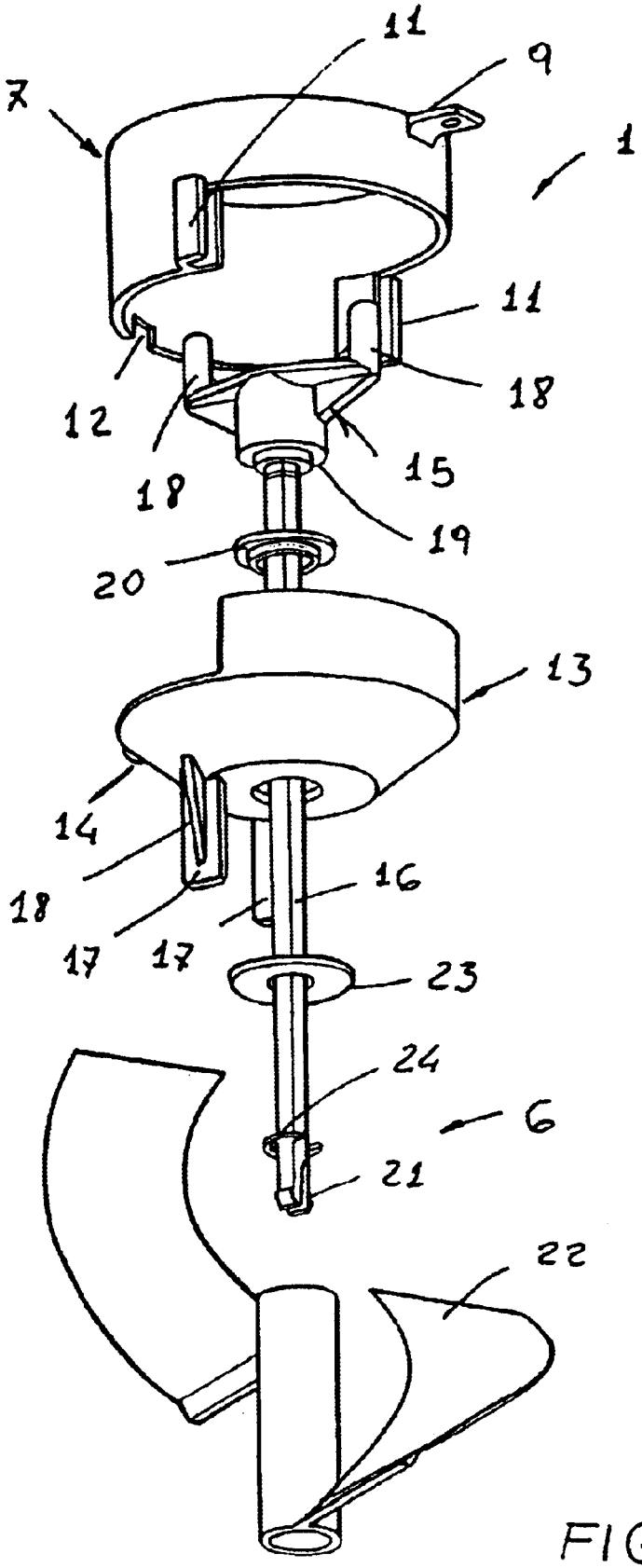
FIG. 3 is a further elevation exploded view illustrating the safety device according to the invention and the stirring assembly associated therewith.

With reference to the number references of the above mentioned figures, the safety stirring device according to the invention, which has been generally indicated by the reference number 1, can be used in a module 2, comprising a vessel 3, containing a paint or other material, and which can be used on a specifically designed shelf, generally indicated by the reference number 4 in FIG. 1, including screw driving means 5, for driving a stirring assembly 6, in a per se manner.

In the embodiment herein shown, the safety device 1 is integrated with the stirring assembly 6, as it will be disclosed in a more detailed manner hereinafter.

The safety device comprises a top cylindric wall 7, at the upper portion of which are provided a tooth element 8 and a perforated bracket 9 for coupling and clamping, for example by a self-threading screw, to the top part 10, comprising the driving screw means 5.

On the side portion of the top cylindric wall two guides 11 are provided, for allowing a stirring cover to be easily located and centered, whereas, at the rear portion of the cylinder, a cut-out or opening 12 is formed, for engaging therein a tooth element 14, formed in a bottom conic portion 13 of the safety device 1.

The latter covers, for an extension of about 180°, a horn element 15 and, by coupling to the top cylindric portion or wall 7, covers all the driven elements, as it will become more apparent hereinafter.

In the bottom conic portion 13, as stated, is formed said tooth element 14 which, in addition to providing a coupling means for coupling with the top cylindric portion or wall 7, prevents the vessel 3 from turning.

In order to further prevent the bottom conic portion 13 from turning and following the shall 16 of the stirring cover, on the bottom conic portion is provided a fork element 17 including a rib 18, counterbiassing the stirring cover so as to prevent any rotary movements, while allowing to compensate for possible height differences of commercially available paint vessels.

In particular, such a compensation can be performed up to a level of 18 mm.

The horn element 15, comprising the stirring shaft 16, is made as a single piece of a plastics material.

At the top portion are moreover provided two coupling cylinders 18 for connection to the driving mechanism 5.

At the underlying portion, moreover, is provided a recess 19 for housing therein a sintered bush 20, for facilitating the rotary of the shaft with respect to the bottom conic portion 13.

The bush 20 is made of a self-lubricating sintered material, and is rigid with the mentioned stirring horn element.

The stirring shaft 16, in particular, is so designed as to present an hexagonal cross-section and, at its end portion is tapering to a smaller cross-section 21, also of hexagonal configuration, for allowing a stirring fan 22 to be plugged in and properly locked, said stirring fan 22 being clamped by the two tooth elements formed at the bottom end portion of the shaft 16.

A sliding ring nut 23 is arranged on the portion underlying the bottom conic portion 13, for preventing this bottom conic portion from contacting a seeger ring element 24, allowing the bottom conic portion 13 to be connected and clamped with respect to said horn element 15.

It has been found that the invention fully achieves the intended aim and objects.

In fact, the invention has provided a safety device which can be used with a lot of different stirring assemblies, to be applied to shelf paint vessels and the like, to safely protect the operators from possible interferences against the driven or movable elements.

In practicing the invention, the used materials, as well as the size and shapes of the several elements constituting the subject device, can be any, depending on the requirements and the status of the art.

What is claimed is:

1. A safety device for stirring assemblies, to be applied to a shelf paint vessel, said safety device including a plurality of movable elements and a top portion having first coupling means to be coupled to a top part of a shelf, driving means, locating and centering means for locating and centering a stirring cover, and second coupling means for coupling to a bottom conic portion of said safety device, and for covering a supporting element for supporting stirring means, said top portion comprising a top cylindric portion having an upper part on which are formed a tooth element and a perforated bracket forming said first coupling means, wherein on a side portion of said top cylindric portion are formed two guides for fitting and entering said stirring cover, at a rear part of said top cylindric portion being formed an opening for engaging therein a tooth element formed on said bottom conic portion of said safety device.

2. A safety device, according to claim 1, wherein said bottom conic portion covers, for an extension of about 180°, a horn element constituting a part of said stirring means and covering, in cooperation with said top cylindric portion, all said movable elements of said safety device.

3. A safety device, according to claim 2, wherein said horn element comprises a stirring shaft, is made as a single piece of a plastic material, and has a top portion where two cylinders for coupling to said driving means are provided.

4. A safety device, according to claim 3, wherein said stirring shaft has a hexagonal cross-section and at a bottom portion thereof is tapering to a smaller cross-section, of hexagonal configuration, for allowing a stirring fan to be plugged-in and locked, said stirring fan being clamped by two tooth elements formed at a bottom end portion of said stirring shaft.

5. A safety device, according to claim 2, wherein said horn element has a bottom portion in which is formed a recess for engaging therein a sintered bush.

6. A safety device, according to claim 5, wherein said sintered bush is made of a sintered auto-lubricating material and is rigid with said stirring horn element.

7. A safety device, according to claim 2, wherein said safety device further comprises a sliding ring nut arranged under said bottom conic portion, for preventing said bottom conic portion from contacting a seeger ring element for coupling and clamping said bottom conic portion to said horn element.

8. A safety device, according to claim 1, wherein said safety device comprises a tooth element for coupling said bottom conic portion to said top cylindric portion while preventing said paint vessel from turning.

9. A safety device, according to claim 8, wherein said safety devices further comprises a bottom fork element having a rib interfering with said stirring cover, thereby preventing any rotary movements while allowing to compensate for possible height differences of different vessel paints.

10. A safety device, according to claim 9, wherein said compensation is achieved up to a level of 18 mm.

* * * * *